US010066796B1

(12) United States Patent
Ward

(10) Patent No.: US 10,066,796 B1
(45) Date of Patent: Sep. 4, 2018

(54) LED LIGHT SYSTEM WITH ELONGATED BODY WITH CAVITY, DIFFUSER AND END CAPS REMOVABLY SECURED THERETO

(71) Applicant: Kevin Ward, Burleson, TX (US)

(72) Inventor: Kevin Ward, Burleson, TX (US)

( * ) Notice: Subject to any disclaimer, the term of this patent is extended or adjusted under 35 U.S.C. 154(b) by 109 days.

(21) Appl. No.: 15/184,166

(22) Filed: Jun. 16, 2016

Related U.S. Application Data

(60) Provisional application No. 62/180,202, filed on Jun. 16, 2015.

(51) Int. Cl.

| | |
|---|---|
| ***F21S 4/28*** | (2016.01) |
| ***F21V 15/015*** | (2006.01) |
| ***F21V 29/83*** | (2015.01) |
| ***F21V 3/04*** | (2018.01) |
| *F21Y 101/02* | (2006.01) |
| *F21Y 103/00* | (2016.01) |

(52) U.S. Cl.
CPC ..... *F21S 4/28* (2016.01); *F21V 3/049* (2013.01); *F21V 15/015* (2013.01); *F21V 29/83* (2015.01); *F21Y 2101/02* (2013.01); *F21Y 2103/003* (2013.01)

(58) Field of Classification Search
CPC .. F21S 4/28; F21S 4/20; F21V 21/025; F21V 23/006; F21V 29/83; F21Y 2115/10
See application file for complete search history.

(56) References Cited

U.S. PATENT DOCUMENTS

| | | | | |
|---|---|---|---|---|
| 8,109,647 | B2 * | 2/2012 | Soo | F21S 8/02 362/217.02 |
| 8,272,764 | B2 * | 9/2012 | Son | F21V 3/02 315/152 |
| 9,618,194 | B2 * | 4/2017 | Tress | F21V 23/006 |
| 2009/0190350 | A1 * | 7/2009 | Tseng | F21S 2/005 362/249.01 |
| 2015/0345768 | A1 * | 12/2015 | Lee | F21V 29/70 362/218 |

* cited by examiner

*Primary Examiner* — Robert May
(74) *Attorney, Agent, or Firm* — Eldredge Law Firm, LLC; Richard Eldredge

(57) ABSTRACT

A LED light system includes an elongated body extending from a first end to a second end; an elongated strip of a plurality of LED lights secured to the raised connector section; a light defusing cover slidingly engaged with the first slot of the first side and with the second slot of the second side, the light defusing cover having a plurality of elongated textured lines for defusing light from the plurality of LED lights, the light defusing cover being configured to cover the cavity of the elongated body; a first removable end cap removably secured to a first end and removably secured to the first side and the second side; and a second removable end cap removably secured to a second end and removably secured to the first side and the second side. The elongated body includes a first side forming a first slot and a first fastening device configured to receive a first fastener; a second side forming a second slot and a second fastening device configured to receive a second fastener; a cavity formed between the first side and the second side; and a raised connector section integrally attached to the first side and the second side.

1 Claim, 3 Drawing Sheets

LED LIGHT SYSTEM WITH ELONGATED BODY WITH CAVITY, DIFFUSER AND END CAPS REMOVABLY SECURED THERETO

BACKGROUND

1. Field of the Invention

The present invention relates generally to transportable enclosure lighting, and more specifically, to a super thin LED (Light Emitting Diode) Light System with specific features referred to as a transportable enclosure light system.

2. Description of Related Art

Transportable enclosures, such as trailers, customized living spaces, mobile command units, etc. contain lights which are a well known in the art and are an effective means of illuminating an enclosed space. In FIG. 1, a commonly known transportable enclosure light system 101 is shown. The light system 101 includes a fixture 103 which houses one or more lamps 105. System 101 is commonly suspended from the ceiling of transportable structures or fixably mounted to a vertical or horizontal surface.

As shown in FIG. 1, the lamps 105 are removable for replacement. The life of a conventional transportable enclosure light system lamp 105 is typically measured in the thousands of hours range which is highly undesirable. Moreover, the lamps of a conventional light system do not handle vibration and shock loads very well which are common in the transportable enclosure industry. Also, the size of conventional light fixtures 103 take up valuable space in the transportable enclosure reducing the overall usable volume. Conventional light fixtures are commonly recessed in effort to reduce the amount of space they consume which, in turn, is costly due to the materials and labor required. Conventional transportable enclosure light systems 101 are much less energy efficient when compared to LED lighting technology. Furthermore, conventional light systems 101 have limited environmental operating conditions such as moderate temperature, humidity, and pressure ranges. These are viewed as disadvantages of conventional transportable enclosure light systems.

Although great strides have been made in the area of transportable enclosure light systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
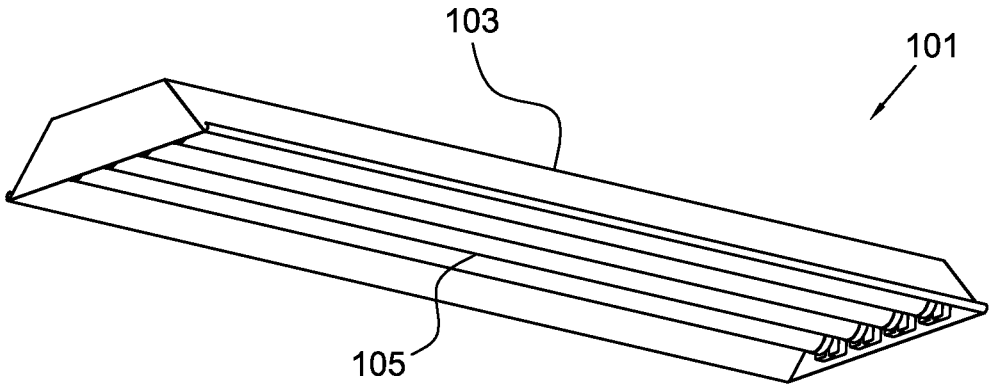
FIG. 1 (PRIOR ART)
FIG. 1 is an oblique view of a conventional transportable enclosure light system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional transportable enclosure lighting systems. Specifically, the system of the present application provides the user with a versatile, very slim profile, long life, energy efficient, low voltage, robust light system. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
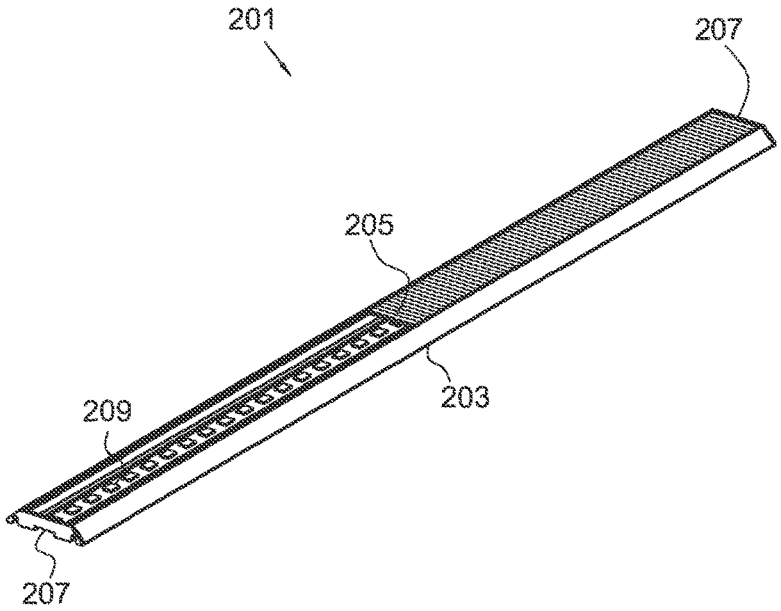
FIG. 2 is an oblique view in accordance with a preferred embodiment of the present application.
Figure 3:
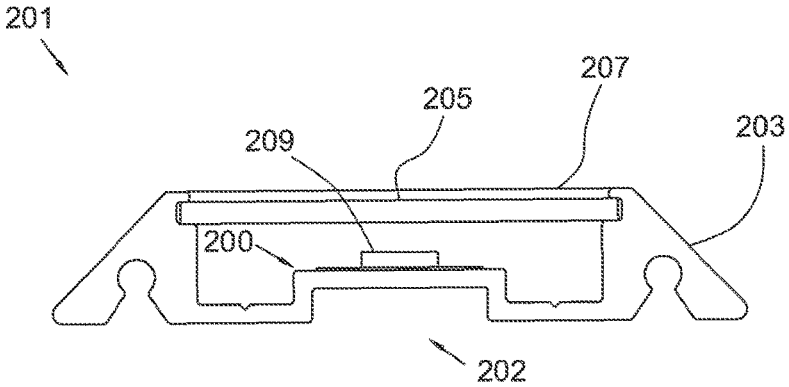
FIG. 3 is a front view of the lighting system of FIG. 2.

Referring now to the drawings wherein like reference characters identify corresponding or similar elements throughout the several views, FIGS. 2 and 3 depict a transportable enclosure light system in accordance with a preferred embodiment of the present application. It will be appreciated that the light system 201 overcomes one or more of the above-listed problems commonly associated with conventional transportable enclosure light systems.

In a preferred embodiment, system 201 includes a light weight, low-profile fixture 203 which houses one or more strips of LED lights 209. The FIG. 203 is uniquely shaped to provide means for several features of the embodiment.

The raised lower center section 200 provides a means for mounting the LED lights 209 while preferably positioning them away from the mounting surface. The space 202 directly under the LED light mounting surface provides a means for air to flow behind the fixture which aids in heat dissipation through convection. This space 202 also accepts various mediums designed to reduce heat such as sheet insulation, ceramic/fire retardant coatings, and radiant barriers. Furthermore, this space 202 is also a natural wire way which eliminates crimping and binding of electrical cables. The fixture 203 geometry accommodates these features while also remaining extremely low profile when compared to conventional light system fixtures. These are viewed as advantages of the system of the present application.

The LED light strip 209 is populated with a plurality of LEDs (light emitting diodes) which are highly advantageous for the transportable enclosure application. A light diffusing cover 205 is removably attached to the fixture 203 and is retained by the unique geometry of fixture 203. As depicted in FIG. 2, the cover 205 contains a plurality of horizontal, textured lines which aid in diffusing the light emitted by the LEDs to the enclosed space. It is appreciated that the cover 205 is depicted partially in FIG. 2 for the sake of clarity and that in reality the cover 205 extends to the ends of the fixture 203. The diffusing cover 205 softens and creates a lined/ribbon of light, making it more comfortable for the user when looking directly at system 201. One or more end caps 207 are removably attached to the fixture 203 and provide a means of enclosing and protecting the internal electronics; e.g. the LEDs 209.

System 201, by design, does not include lamps which need to be frequently replaced; hence, the approximate, maintenance-free, continuous use lifespan of the exemplary embodiment is over a decade. LED lights are today's most efficient way of illumination and lighting, with an estimated energy efficiency of 80%-90% when compared to traditional lighting and conventional light bulbs. This means that about 80% of the electrical energy is converted to light, while the other 20% is lost and converted into other forms of energy such as heat. Additionally, the overall size of system 201 is much more compact than conventional transportable enclosure light systems enabling users to easily flush mount the fixtures and eliminate the issues associated with recess mounting. These are viewed as advantages of the system of the present application.

It is contemplated that the cover 205's material, texture, and transparency is highly configurable in alternative embodiments; therefore, a preferred configuration is given in FIGS. 2 & 3 to capture the spirit of the application. It is appreciated that the cover 205 containing horizontal, textured lines is precisely and intentionally spaced from the LED lights 209 to provide a unique ribbon of light. This is viewed as another advantage of the system of the present application. It is also contemplated that seals can be added to the end caps 207 and cover 205 to provide for an environmental rating. It is also contemplated that the uniquely shaped geometry of the fixture 203 provides a means for multiple light systems 201 to be interconnected on end (in series).

Figure 4:
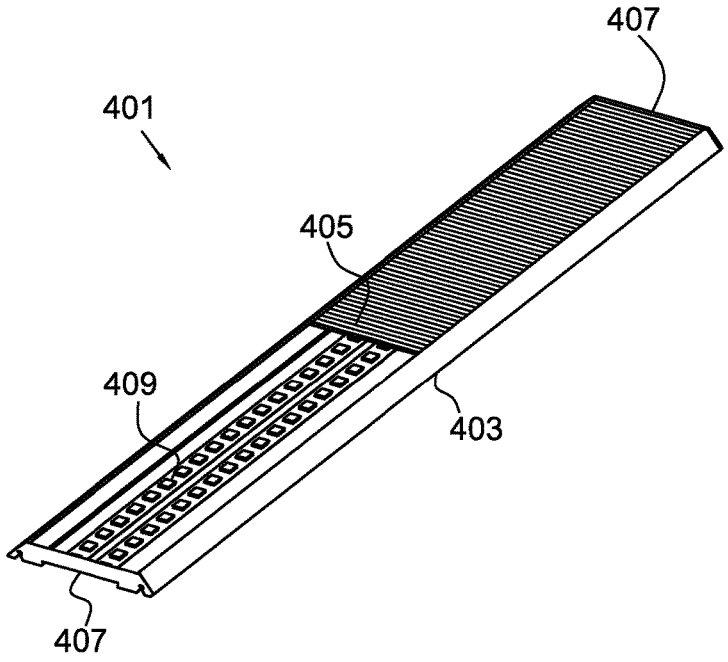
FIG. 4 is an oblique view in accordance with an alternative embodiment of the present application.
Figure 5:
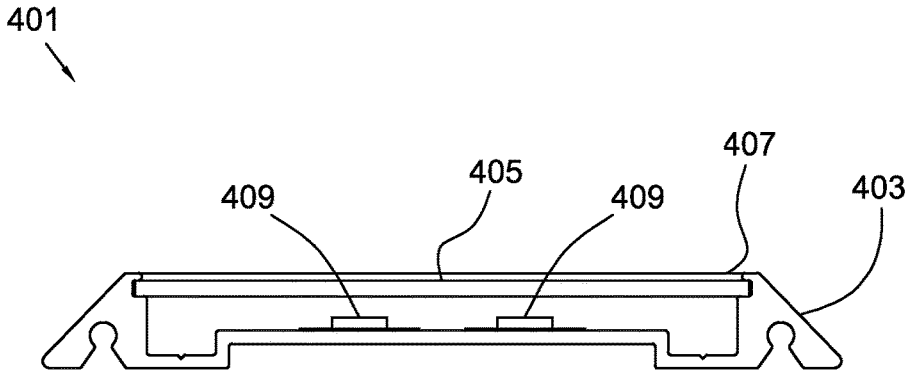
FIG. 5 is a front view in of the lighting system of FIG. 4.

Referring now to FIGS. 4 & 5, oblique and front views of system 401 are shown in accordance with an alternative embodiment of the present application, respectively. System 401 is substantially similar in function to system 201 and it is contemplated interchanging the features of the different types of the systems discussed herein.

In this embodiment, system 401 includes a light weight, low-profile fixture 403 which houses one or more strips of LED lights 409. Similar to system 201, system 401 also includes a light diffusing cover 405 and one or more end caps 407. It is appreciated that system 401 contains all of the advantages and features of system 201 due to the substantial similarities.

As depicted in FIGS. 4 and 5, the distinctively shaped fixture 403 provides a means for mounting the LED lights 409 away from the fixture mounting surface while making a provision for heat dissipation, cable routing, and insulation. In this embodiment, fixture 403 is preferably wider enabling relatively more LED lights 209 to be mounted. Hence, the light emitted from system 401 is substantially more than system 201 while the overall profile size is only minimally larger in the width dimension.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A LED light system configured to secure to a support structure, comprising:

an elongated body extending from a first end to a second end, the elongated body having:
- a first side forming a first slot;
- a second side forming a second slot;
- a cavity formed between the first side and the second side; and
- a raised lower center section integrally attached to the first side and the second side, the raised lower center section having:
  - an upper surface and a lower surface, the lower surface forming a elongated space extending from the first end to the second end, the first side and the second side come into contact with the support structure, while the raised lower section is at a distance from the support structure via the elongated spaced formed therebetween;

an elongated strip of a plurality of LED lights secured to the upper surface of the raised lower center section;

a flat light diffusing cover slidingly engaged with the first slot of the first side and with the second slot of the second side, the flat light diffusing cover having a plurality of elongated textured lines for diffusing light from the plurality of LED lights, the light diffusing cover being configured to cover the cavity of the elongated body;

a first removable end cap removably secured to a first end and removably secured to the first side and the second side; and a second removable end cap removably secured to a second end and removably secured to the first side and the second side;

wherein the first end cap and the second end cap are configured to secure the light diffusing cover in a fixed position.

* * * * *